United States Patent [19]

Dotson

[11] Patent Number: 5,020,176

[45] Date of Patent: Jun. 4, 1991

[54] CONTROL SYSTEM FOR FLUID-FILLED BEDS

[75] Inventor: Derek P. Dotson, Thousand Oaks, Calif.

[73] Assignee: Angel Echevarria Co., Inc., Los Angeles, Calif.

[21] Appl. No.: 424,863

[22] Filed: Oct. 20, 1989

[51] Int. Cl.[5] ..... F16K 31/12; A47C 21/08

[52] U.S. Cl. ..... 5/453; 5/455; 137/487.5; 417/38

[58] Field of Search ..... 5/453, 456, 449, 454, 5/455; 137/487.5; 297/DIG. 3; 417/18, 20, 38

[56] References Cited

U.S. PATENT DOCUMENTS

| | | | |
|---|---|---|---|
| 4,297,755 | 11/1981 | Mollura | 5/453 |
| 4,394,784 | 7/1983 | Swenson | 5/455 |
| 4,435,864 | 3/1984 | Callaway | 5/453 |
| 4,634,179 | 1/1987 | Hashimoto | 297/DIG. 3 |
| 4,720,807 | 1/1988 | Ferran | 137/487.5 |
| 4,803,744 | 2/1989 | Peck | 5/453 |
| 4,829,616 | 5/1989 | Walker | 5/449 |
| 4,838,309 | 6/1989 | Goodwin | 5/456 |
| 4,873,737 | 10/1989 | Savenije | 5/455 |

*Primary Examiner*—Gary L. Smith
*Assistant Examiner*—F. Saether
*Attorney, Agent, or Firm*—Henry M. Bissell

[57] ABSTRACT

A system for automatically controlling the pressure maintained in a plurality of fluid-filled cylinders supporting a sleep surface in order to maintain a desired degree of firmness/softness. In one mode, the system permits the user to set the desired level of firmness and then the system acts to maintain that level under the conditions encountered in use, either venting if an above-setting pressure is sensed or pumping to fill if a below-setting pressure is detected. In another mode, the user is enabled to manually activate either the pump or the vent in order to vary the firmness to his choice.

21 Claims, 3 Drawing Sheets

CONTROL SYSTEM FOR FLUID-FILLED BEDS

BACKGROUND OF THE INVENTION

1. Field of the Invention

The present invention generally relates to fluid-filled beds, such as water beds or inflated tube mattresses, and more particularly relates to an automatic control system for such beds.

2. Description of the Related Art

Beds and mattresses, sometimes referred to as sleep surfaces, have long been an important item of furniture in homes, temporary lodgings, or wherever people go when in need of sleep. On the average, a person spends about one-third (eight hours, more or less, of each twenty-four hour interval) of his life in bed. Clearly, the degree of comfort provided by one's bed is important to the user.

Various factors contribute to or detract from the comfort of a bed: the surface "terrain", whether smooth or lumpy; the degree of firmness; the type and uniformity of support over the sleep surface; etc. An uncomfortable bed may interfere with sleep by keeping a person from going to sleep readily or by causing the person to sleep fitfully during the night. Even a bed that is not noticeably uncomfortable may still cause the user to awake in the morning with certain aches and pains, stiffness or the like as a result of an unsatisfactory sleep surface.

Until the introduction of coil springs, improvements in the designs of beds were directed more to their shapes and configurations, such as their use of paneling with posts supporting a canopy, etc., than to the degree of comfort afforded the occupants. With the development of coil springs, which were first fitted into mattresses in the early 19th century, bed comfort was transformed. Over the next 150 years or so, beds evolved into the general form in common use today, generally a metal frame supporting a spring structure on which a mattress, which may also incorporate springs, a foam or similar support or a combination of the two, is placed.

With 150 years of development, the current coil spring bed with an inner spring mattress has about reached the pinnacle of its design. Current innovation in the development of beds and mattresses involves the use of fluid supported sleep surfaces. The waterbed, as it was known, which became a minor fad about a generation ago, was in its simplest form merely a plastic sack or bag which was filled with water. It was noted for its "wave action", which contributed to new sleep sensations; for its substantial weight because of the volume of water involved; and for its tendency to develop leaks. These two latter aspects gave the term "water bed" an unpleasant connotation, particularly with landlords whose rented apartments were sometimes damaged by tenants' water beds.

The problems with waterbeds of the single cell type have been largely overcome by the substitution of a plurality of water filled cylindrical containers as support members. These are typically arrayed side by side in a central cavity in the bed structure. Since each container only holds about thirty pounds of water, they can be manipulated much more readily, and a leak in one container is not disastrous because the volume which is involved is much less; also, a waterproof liner in the cavity is adequate to contain water from a leaking cylinder. The multi-cell configuration provides one outstanding advantage, in addition to eliminating the wave action of the "water bag", in that it is possible to vary the firmness of the sleep surface from one side of the bed to the other, simply by adjusting the degree to which the individual cylinders are filled with water.

Most recently, advances in bed design have been directed to achieving the capability of adjusting the degree of firmness of support automatically at different points of the sleep surface by using a settable control, much like the temperature of two sides of an electric blanket can be individually adjusted by setting a rheostat in a control system which includes sensors capable of monitoring temperature or some analog thereof. A feature such as the automatic control of the degree of support of the sleep surface with maintenance of the apparent firmness at a present level, selectable by the user, regardless of the load on the sleep surface, is a highly desirable attribute in a bed where sleep comfort is important to the user. It is also desirable from the standpoint of salability of the product, since it is a feature that provides a favorable comparison with other types of beds which are incapable of providing such a feature.

Accordingly, it is a general object of the present invention to provide a system for a fluid supported bed which allows selection of a setting which is variable over a range of firmness levels. It is a further object of the present invention to provide such a system which has the capability of automatically adjusting the degree of support to accord to the preset firmness level as the load on the sleep surface changes, as when a person moves around on the sleep surface or gets on or off the bed.

SUMMARY OF THE INVENTION

In brief, arrangements in accordance with the present invention comprise a fluid pump coupled to pressurize the plurality of chambers of a fluid flotation bed. Associated with the pump is a controller which includes a venting device, sensors for monitoring the firmness level of the sleep surface as determined by the pressurized cylinders, selection and display elements for interfacing with the user, and a special purpose computer for activating the pump and venting valve in response to sensor signals, relative to the predetermined settings of the selection element.

In one particular arrangement in accordance with the invention which is specifically adapted for pneumatic operation, the pump is an air pump and the vent valve is arranged to vent to atmosphere. Moreover, where the plurality of cylinders is organized in two sets so that the firmness of the sleep surface may be separately determined for the two opposite sides of the bed, the cylinders are connected by sets to corresponding individual plenum chambers, each of which is separately associated with venting and pumping means. Separate sensors are provided for the two independent systems and dual channels are incorporated in the computer to provide independent control of the two sets of cylinders. Alternatively, the sensing and control of respective pressures in the individual sets of cylinders may be conducted on a time multiplex basis with the computer being switched alternately between the sensors and selectors of the respective systems and valving being activated to connect the vent and/or pump to the particular system calling for venting or pumping at a given time.

In accordance with one particular aspect of the invention, the controller operates on a repetitive cycle, whenever power is on, to update the display element in accordance with the existing condition of the cylinders which are associated therewith and to monitor the status of the selection element, preferably a push button device having selection keys for "firm", "soft", and "manual". If one of the push buttons is pressed, the CPU logic determines which push button is activated and controls the system accordingly. Computer memory stores the setting which is keyed in by the user. When in the automatic mode, pressing the "firm" push button increments the pressure setting, while pressing the "soft" push button decrements the pressure setting.

At the beginning of each monitoring cycle, the computer checks the bed pressure as indicated by the associated sensor and compares it with the preset level. If the pressure is above the set level by a predetermined threshold amount, the vent valve is opened for a predetermined reference interval. This interval is typically in the range of 10 to 15 seconds for a king size bed of the type described. A queen size bed, being somewhat smaller, will have a slightly shorter reference interval. Other factors, such as the size of pump and vent, may also enter into the choice of a reference interval. Thereafter, the bed pressure is read again and a calculation is made to determine the difference between the bed pressure and the level setting. The computer then selects a vent time interval corresponding to that calculated difference and opens the vent valve for that interval. Another reading is taken and, if the pressure is still above the desired setting by more than the threshold amount, further venting occurs for a recalculated interval. For example, if the pressure difference is 0.4 psi and the system vented 0.2 psi in fifteen seconds, a vent interval of 30 seconds (2 times 15 seconds) is selected.

Similarly, if the sensed pressure is below the preset level by a predetermined threshold amount, the pump is activated for a predetermined reference interval which may correspond to the predetermined reference interval for venting, but can be different if other considerations call for it. The bed pressure is again tested and a calculation of the difference is made. The computer then selects a corresponding time interval and activates the pump for that interval. Pumping to a desired pressure is controlled in the same way that venting is controlled, as described above. In this way, the system is controlled to approach the fluid pressure level which is preset by the user without overshoot or undesirable oscillations about the preset value. Furthermore, the microprocessor is free to continue its cycling procedure while venting or pumping is taking place for the calculated interval.

The "manual" key is a toggle which shifts between a manual mode and an automatic mode each time it is pressed. When in "manual" mode, pressing the "firm" button, activates the pump which continues to pump fluid into the bed until the selection button is released. If the "soft" button is pressed, the vent is activated and will release fluid until the button is released. With each successive cycle, the display is updated to the current pressure value, converted to an indication of relative firmness, as monitored by the system sensor.

BRIEF DESCRIPTION OF THE DRAWING

A better understanding of the present invention may be gained from a consideration of the following detailed description, taken in conjunction with the accompanying drawing in which.

DESCRIPTION OF THE PREFERRED EMBODIMENTS

Figure 1:
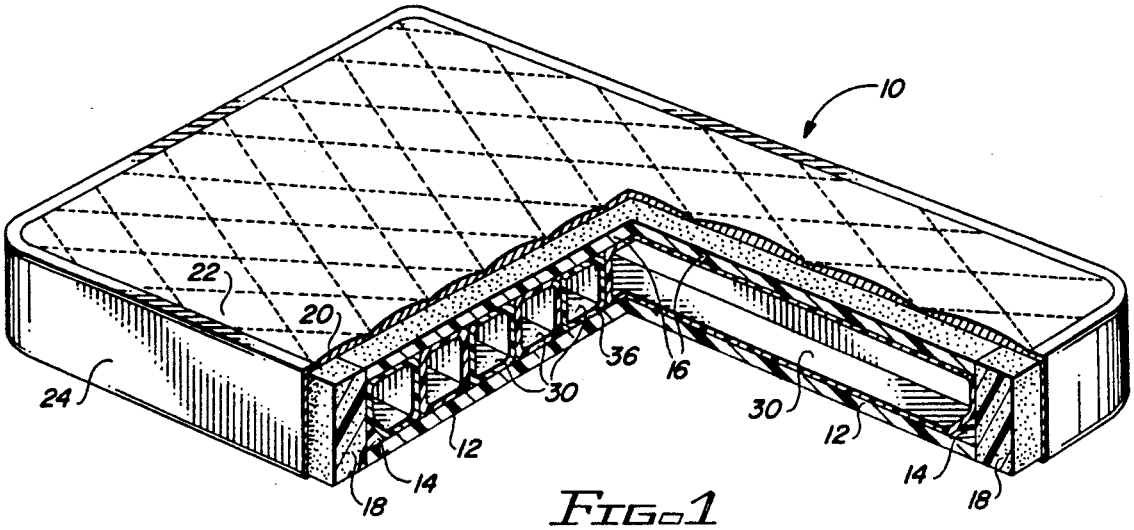
FIG. 1 (PRIOR ART)
FIG. 1 is a perspective view, partially cut away, of a fluid flotation bed having a plurality of pressurized cylinders of the type with which the present invention is associated.

FIG. 1 illustrates fluid flotation sleep surface 10. The exterior of the structure is formed as a pair of bordered panels or frames, the outer margins of which have substantial height and register together so as to define an interior cavity or enclosed volume into which the fluid-filled containers can be incorporated. The bottom panel structure comprises a base urethane foam sheet 12, to the outer periphery of which is secured a border member comprising a wedge-shaped or inclined foam wall 14 which is joined to the margin of the base foam sheet 12 about its periphery. The area defined within the inclined surfaces of the wedges 14 comprises a well or open cavity under the principal sleep surface of the mattress 10. The top panel has a centrally disposed urethane foam layer 16 and an outer peripheral border of resilient foam 18 of rectangular cross-section that is substantially the height of the mattress. The mattress cover comprises a quilted top surface of polyurethane foam and polyester ticking, the foam layer 20 being of substantial height so that the foam layer 20 is unified with the ticking 22. A side quilted margin 24, which may be of urethane fabric, extends around the periphery.

Within the interior of the enclosed volume thus defined when the top panel is registered over the bottom panel, there is disposed a plurality of generally cylindrical containers 30 in the form of elongated sealed tubes having a nominal diameter of approximately 5" when filled. For a king size sleep surface, nine of the containers, or tubes, 30 are sufficient. Each tube includes a fill opening which will be described in more detail hereinafter. The tubes 30 are pliant and flexible, in the sense that they conform freely to the body of an occupant of the bed when the tube is substantially filled. The tubes 30 can be filled or pressurized to varying degrees so as to comprise a range of support for the sleep surface. The support can be uniform across the area, or varied with different tubes. With a double or large size bed, to be used by two persons, support on each side can be tailored to the desires of each individual.

Underneath the tubes 30 and disposed across the top of the bottom panel in the event water is the support medium is a water carrier or collector sheet 36 which fits into the concavity defined by the top of the foam sheet 12 and within the inclined surfaces defined by the wedges 14. It is advantageous, for cost and durability purposes, to use tubes 30 of approximately 20 mil thick plastic. Other thicknesses of materials may be used as appropriate for the materials employed, the specific use to be made of the product and other considerations which may apply.

The preferred embodiment of the invention is disclosed in the context of a pneumatic bed, in which the cylinders are pressurized with air, the pump is an air pump and the venting means vents to atmosphere. It will be understood that this is by way of illustration and not limitation. The system of the invention can be utilized in accordance with liquid-filled cylinders with the addition of a storage reservoir for receiving liquid which is vented from the support system and from which a liquid pump draws liquid with which to pressurize the cylinders. Alternatively, the system can be a hybrid, if desired, in which a base or foundation level of support is afforded by a liquid medium and the differential pressure level is determined by pumping air into the cylinders or venting air to atmosphere.

Figure 2:
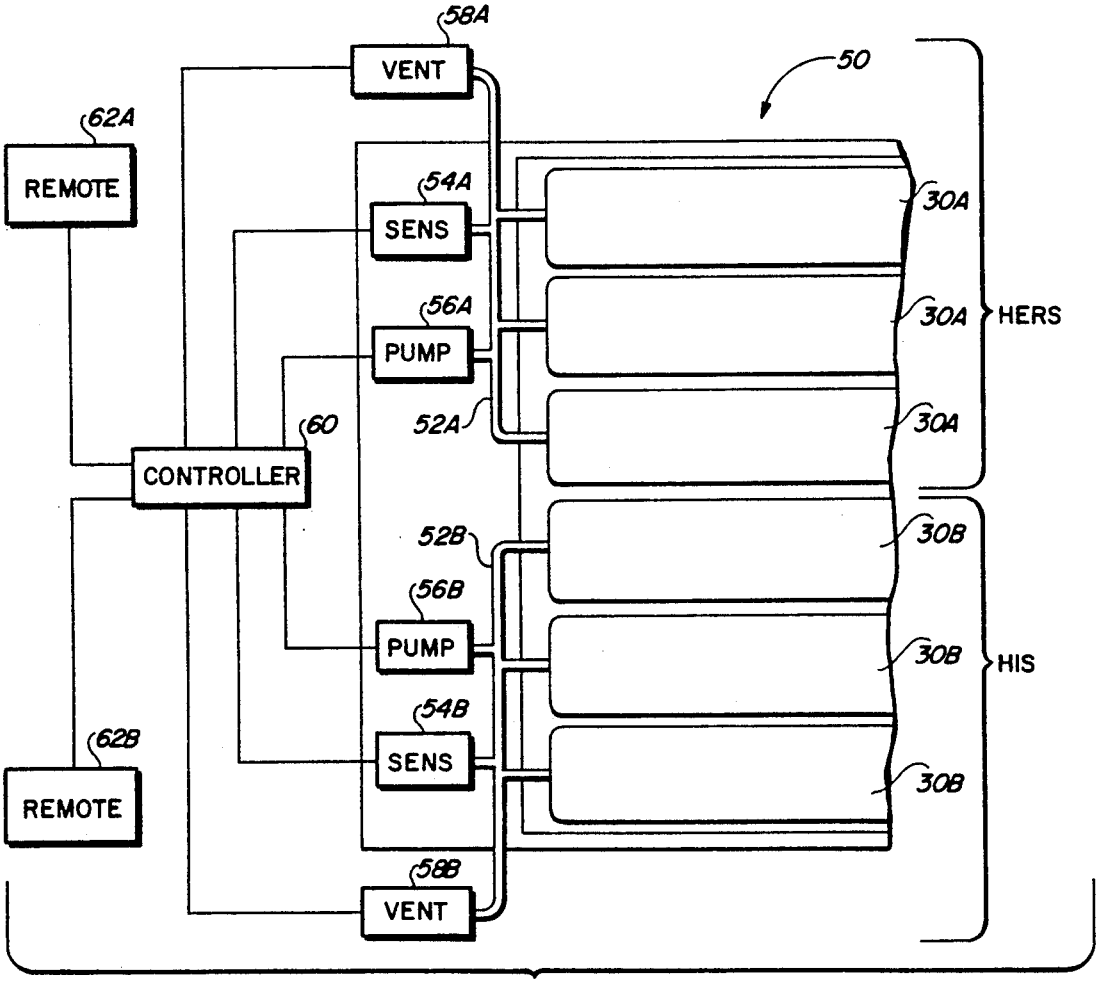
FIG. 2 is a schematic diagram of one particular arrangement in accordance with the present invention showing the cylinders of the fluid flotation bed of FIG. 1 interconnected to form a dual system.

FIG. 2 shows a system 50 in accordance with the present invention in which six cylinders 30 are interconnected in two sets of cylinders 30A and 30B. The three cylinders in a set are coupled to an associated plenum chamber 52 to which are connected a sensor 54 and a pump 56. The plenum chamber 52 also connects to a vent 58. Like connections are made to the two sets of cylinders 30A and 30B, and the respective elements are designated with the letters "A" or "B" accordingly. A controller 60 is shown intercoupled with all sensors, pumps, and vents, as well as to a pair of remote control units 62A, 62B.

Figure 3:
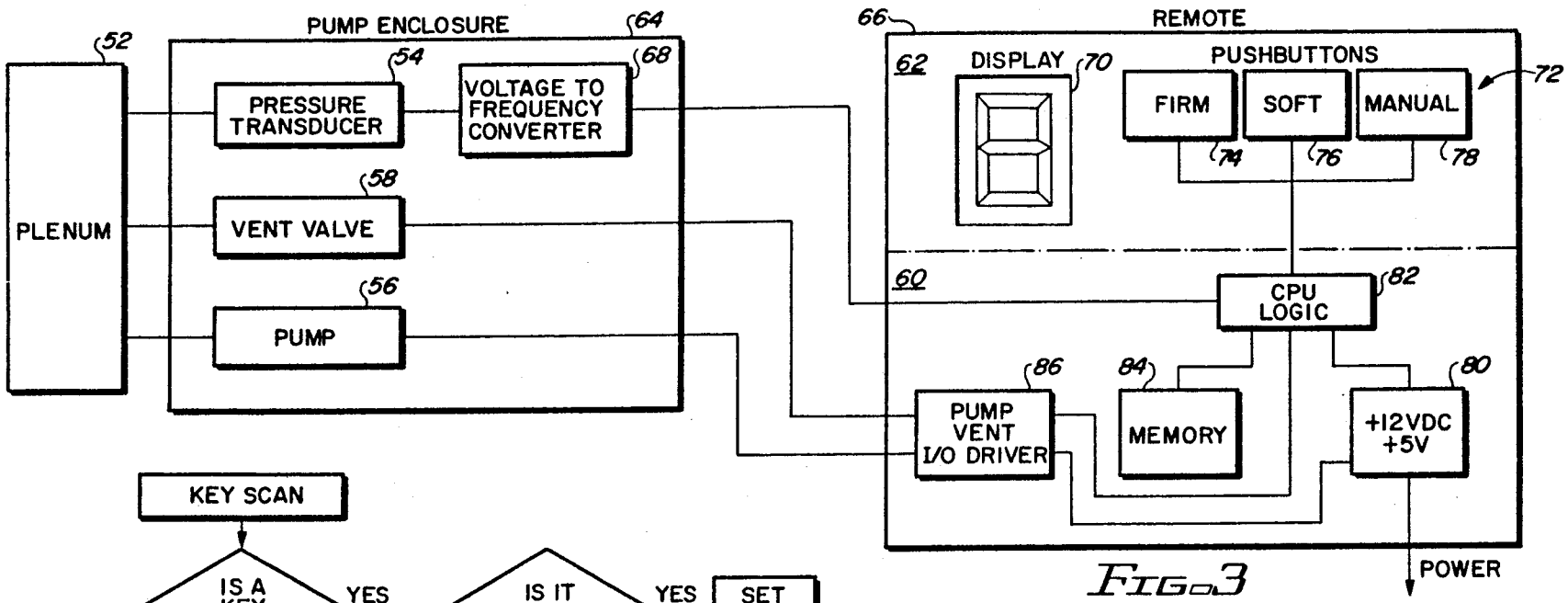
FIG. 3 is a schematic block diagram of a controller and pressurizing system in accordance with the present invention for controlling the firmness of one of the cylinder sets shown in FIG. 2.

FIG. 3 is a schematic block diagram illustrating the operative elements for controlling the pressure in the containers 30 of FIG. 2. As indicated in FIG. 3, each pressure controlled system principally comprises three units, a plenum 52, a pump enclosure 64 and a remote unit 66. The pump enclosure 64 contains the pressure transducer or sensor 54 coupled to a converter 66 for converting output voltage from the sensor 54 to a corresponding frequency signal to be sent to the remote unit 66, a vent valve 58 and a pump 56. The remote unit 66 contains the remote control 62 and associated controller 60. The remote control 62 has a display element 70 and a selector device in the form of a set 72 of push buttons 74, 76 and 78 respectively designated "firm", "soft", and "manual". The controller 60 has a power adaptor 80, a microprocessor 82 including memory 84 and a driver stage 86. The CPU receives input signals from the push button set 72, and it controls the display 70 in accordance with the operation of the system. Signals from the sensor 54 are also applied to the microprocessor 82 which controls the driver 86 to open or close the vent valve 58 and activate the pump 56 accordingly.

Figure 4:
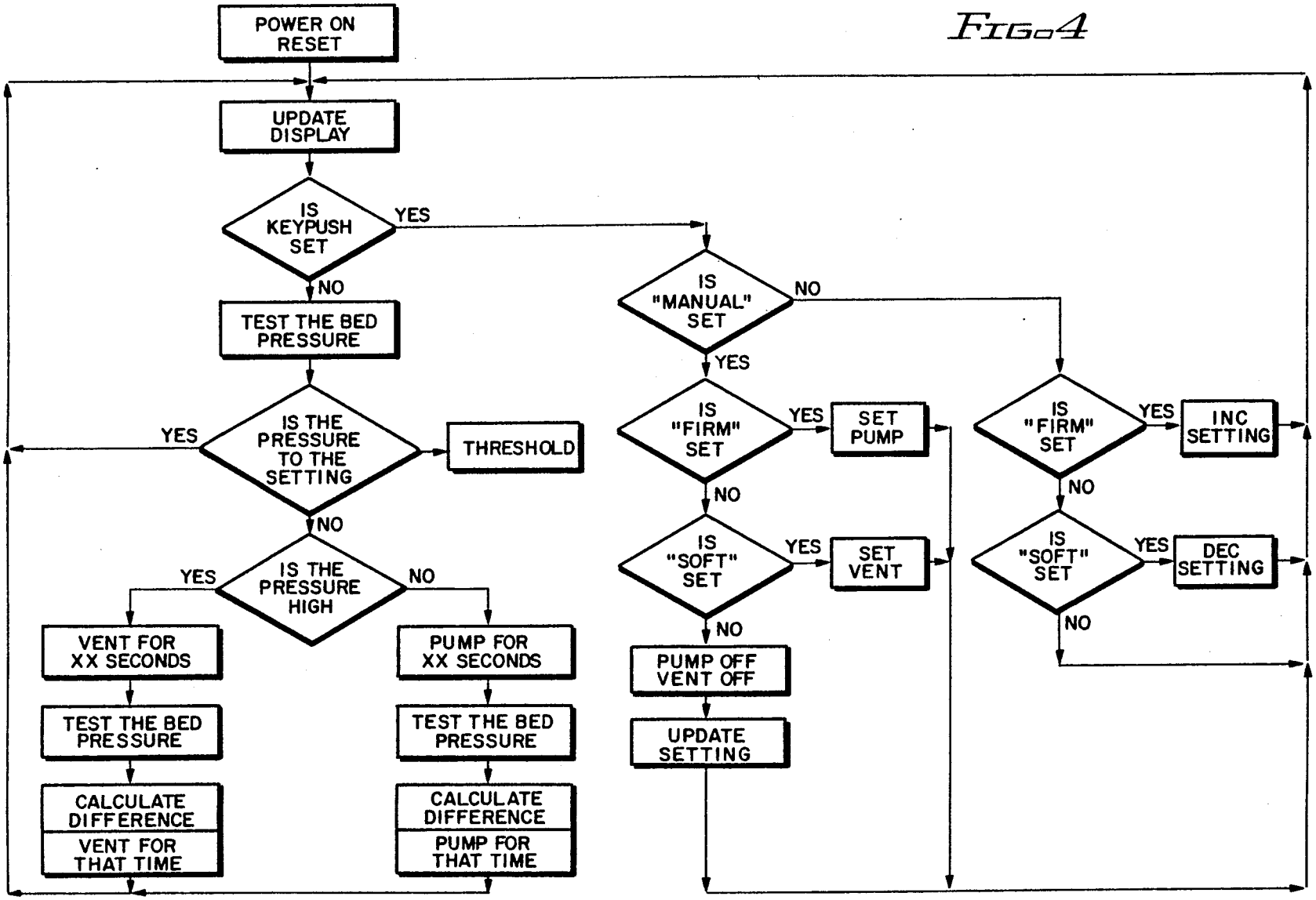
FIG. 4 is a flow chart illustrating the method of operation of the arrangement of FIG. 3.

FIG. 4 is a flow chart illustrating the operation of the controller 60 of FIG. 3. All elements are reset to default conditions when power is turned on. Thereafter the display element 70 is updated and the key set 72 is interrogated. If its state is active, the operation moves along the branch to the right to determine which of the push buttons is pressed. In the automatic mode (not "manual") if one of the buttons 74 or 76 is pressed, the selected pressure setting of the display is incremented or decremented, depending upon whether a firmer or softer setting is desired. If neither of the buttons 74 or 76 is depressed, the operation drops through to the beginning of the next cycle.

In the "manual" mode, pressing one of the buttons 74 or 76 activates the corresponding element, pump or vent, to adjust the firmness to suit the user. Thus if the "firm" button 74 is pressed, the pump 56 is activated. If the "soft" button 76 is pressed, the vent valve 58 is activated to reduce pressure. In manual mode, if neither button 74 or 76 is pressed, the pump and vent are turned off and the display setting is updated.

During normal cycling of the microprocessor, if no key push setting is encountered, the microprocessor proceeds to test the bed pressure by sensing the signal from the transducer 54 which it then compares with the pressure setting as determined by the remote control 62. If the measured pressure corresponds to the setting, the cycle is completed. If the pressure does not correspond to the setting, a determination is made as to whether the pressure is above or below the setting. If above the setting, the vent valve is opened for a predetermined reference interval: for example, 15 seconds for a large bed. At the end of that interval, the pressure is checked again and the microprocessor 82 calculates the difference between the pressures at the beginning and end of the vent reference interval and uses this data to establish a period that the vent valve is to remain open in order to bring the bed pressure to the selected setting. The process is repeated on the next clock cycle and further venting is conducted if the pressure is still above the setting by the threshold amount. If the pressure is below the setting by the threshold amount, the pump is activated for a predetermined pump reference interval. Bed pressure is tested again and a calculation is performed to determine the difference between the pressures at the beginning and end of the reference interval. This data is used to determine a time interval that the pump should run in order to bring the pressure to the selected setting. The cycle is repeated until the pressure is brought within the pressure threshold of the selected setting.

Figure 5:
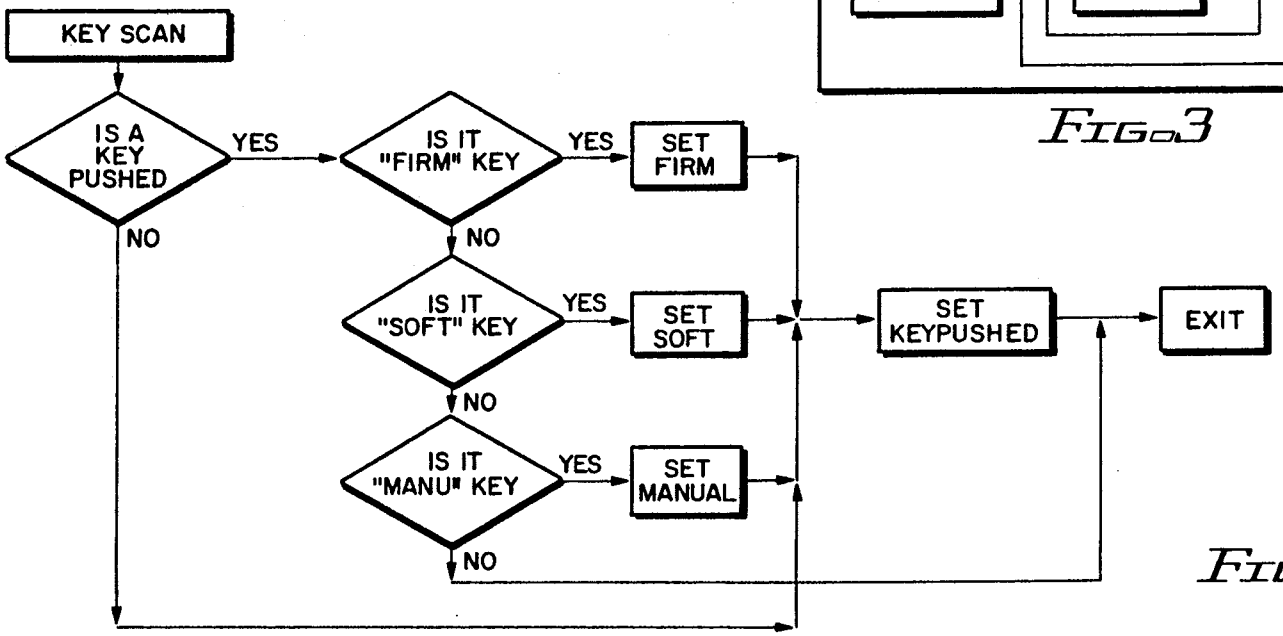
FIG. 5 is another flow chart illustrating the operation of a portion of the arrangement of FIG. 3.

FIG. 5 is a flow chart indicating the operation of the microprocessor 82 in association with the push button set 72 of FIG. 3. The key set is scanned to determine if a button is pressed. If no button is pressed, the status of the button set 72 is set accordingly to either manual or automatic mode, depending upon the last setting of the "manual" button 78. If either of the "soft" or "firm" buttons 74, 76 is pressed, the readout stage of the button set 72 is set accordingly.

Through the use of the present invention, variations in firmness/softness of the sleep surface can be controlled as easily as one controls the temperature developed by an electric blanket. The controller and the selector buttons and display element are located in a remote hand-held unit which would typically be placed on a night stand adjacent the bed. For a dual bed system, two such remote control units are provided, one for each side of the bed. Just as with an electric blanket preset temperature setting, a particular level of firmness is preset and the system inflates the pneumatic cylinders to that level upon energization of the system. Adjustment is automatically made whenever changes in pressure are detected, as when a person gets into or out of bed. In addition, if the user wishes to change the level of firmness directly to a level he is comfortable with, he can control the system manually until the system reaches his desired level of firmness. At this point he can change back to automatic mode and adjust the firmness setting until neither venting nor pumping occurs. In this way the arbitrary scale or range of settings in automatic mode can be quantitatively correlated to the user's own "feel" of bed firmness for maximum comfort and user satisfaction.

Although there have been described above specific arrangements of a control system for fluid-filled beds in accordance with the invention for the purpose of illustrating the manner in which the invention may be used to advantage, it will be appreciated that the invention is not limited thereto. Accordingly all modifications, variations or equivalent arrangements which may occur to those skilled in the art should be considered to be within the scope of the invention as defined in the annexed claims.

What is claimed is:

1. A control system for a fluid-filled bed comprising:
a plurality of containers for receiving fluid from a pressurized source, said containers being arranged to support a fluid flotation sleep surface;
means coupling said containers to a common plenum chamber;
a sensor for monitoring the pressure of fluid in said chamber;
a pump for supplying fluid to said chamber;
a valve for venting fluid from said chamber;
a selector device for setting a chosen level of firmness corresponding to pressure within said containers and chamber; and
control means for comparing pressure signals from said sensor with said chosen firmness setting and selectively activating said pump and said venting valve upon detection of a difference between said pressure signals and said setting which exceeds a predetermined threshold value where said threshold value is greater than zero.

2. The system of claim 1 wherein said control means comprise means for repetitively monitoring said sensor and said selector device.

3. The system of claim 2 wherein said control means comprise means for activating the venting valve for a predetermined reference interval of time, recording the chamber pressures at the beginning and end of said interval, calculating a vent interval required to reduce the chamber pressure to said chosen level based on the pressure change measured during said reference interval, and activating said venting valve for said reference interval and subsequently activating the venting valve for said calculated vent interval.

4. The system of claim 3 wherein said control means further include means for subsequently comparing sensed chamber pressure with said chosen level and repeating the measurement of pressure change during a reference venting interval and calculation of a subsequent vent interval if further reduction of pressure is required.

5. The system of claim 2 wherein said control means comprise means for activating the pump for a predetermined reference interval of time, recording the chamber pressures at the beginning and end of said interval, calculating a pump interval required to increase the chamber pressure to said chosen level based on the pressure change measured during said reference interval and subsequently activating the pump for said calculated pump interval.

6. The system of claim 3 wherein said control means further include means for subsequently comparing sensed chamber pressure with said chosen level and repeating the measurement of pressure change during a reference pump interval and calculation of a subsequent pump interval if further increase of pressure is required.

7. A fluid-filled bed comprising a plurality of panels assembled to form a base and peripheral border frame defining an interior cavity for receiving and supporting a plurality of individual fluid containers positioned in side-by-side relationship within said cavity;
a fluid flotation sleep surface for extending over the space defined by said cavity to enclose said cavity; and
a control system for said fluid-filled bed in accordance with claim 1.

8. The fluid-filled bed of claim 7, further including a second control system in accordance with claim 1, the two control systems having separate pluralities of containers juxtaposed side by side within said cavity and being independent of one another to provide separate control of the firmness on opposite sides of the bed.

9. The bed of claim 8 wherein said fluid is air.

10. The system of claim 1 wherein the selector device includes means for selecting between automatic and manual mode for the operation of said control system.

11. The system of claim 10 wherein the selector device further includes a "firm" key to increase firmness and a "soft" key to decrease firmness, and means for incrementing the preset firmness level in response to actuation of the "firm" key when the system is in the automatic mode.

12. The system of claim 11 further including means for decrementing the preset firmness level in response to activation of the "soft" key when the system is in the automatic mode.

13. The system of claim 11 further including means for directly energizing the pump in response to activation of the "firm" key when the system is in the manual mode.

14. The system of claim 11 further including means for directly opening the venting valve in response to activation of the "soft" key when the system is in the manual mode.

15. The system of claim 1 further including a display element for displaying a visual indication of system status.

16. The system of claim 15 including means for activating said display element to provide a visual indication of preset firmness level.

17. The system of claim 15 further including means for activating the display element to provide a visual indication of relative firmness corresponding to pressure of fluid in said chamber.

18. The method of controlling the pressure of fluid in a fluid-filled bed, which bed comprises a plurality of fluid containers coupled for communication with a common plenum chamber, a sensor for monitoring the pressure of fluid in said chamber, a pump for supplying fluid to said chamber, a valve for venting fluid from said chamber, and a selector device for setting a chosen level of firmness corresponding to pressure within said containers and chamber, said method comprising the steps of:
(a) comparing the pressure in said chamber with the preset firmness level to determine the existence of a difference which exceeds a predetermined threshold value, said threshold value being greater than zero;
(b) activating the venting valve for a predetermined reference interval of time in the event said sensed pressure is higher than the preset firmness level by more than said threshold value;
(c) noting the chamber pressures at the beginning and end of said reference interval;
(d) calculating a vent interval which is required to reduce the chamber pressure to said preset firmness level, based on the pressure change detected during said reference interval; and (e) activating the venting valve for said calculated vent interval.

19. The method of claim 18 further including the steps of again comparing the pressure in said chamber with the preset firmness level and repeating steps (b), (c), (d), and (e) in the event that the chamber pressure is still higher than the preset firmness level by more than said threshold value.

20. The method of claim 18 further including the steps of:

(f) comparing the pressure in said chamber with the preset firmness level to determine the existence of a difference which exceeds a predetermined threshold value;

(g) activating the pump for a predetermined reference interval of time in the event said sensed pressure is lower than the preset firmness level by more than said threshold value;

(h) noting the chamber pressures at the beginning and end of said reference interval;

(i) calculating a pump interval which is required to increase the chamber pressure to said preset firmness level, based on the pressure change detected during said reference interval; and (j) activating the pump for said calculated pump interval.

21. The method of claim 20 further including the steps of again comparing the pressure in said chamber with the preset firmness level and repeating steps (g), (h), (i) and (j) in the event that the chamber pressure is still lower than the preset firmness level by more than said threshold value.

* * * * *